US006168388B1

(12) United States Patent
Hughes et al.

(10) Patent No.: US 6,168,388 B1
(45) Date of Patent: Jan. 2, 2001

(54) DUAL PUMP SYSTEM IN WHICH THE DISCHARGE OF A FIRST PUMP IS USED TO POWER A SECOND PUMP

(75) Inventors: Anthony D Hughes, Swindon; Graham Anderson, London, both of (GB); W. Keith Russell, Singapore (SG); Nathan Thompson, Tomball, TX (US)

(73) Assignee: Camco International, Inc., Houston, TX (US)

( * ) Notice: Under 35 U.S.C. 154(b), the term of this patent shall be extended for 0 days.

(21) Appl. No.: 09/234,987

(22) Filed: Jan. 21, 1999

(51) Int. Cl.[7] ..... F04B 3/00

(52) U.S. Cl. ..... 417/245; 417/76; 417/84; 417/53; 417/54; 166/105; 166/313

(58) Field of Search ..... 417/521, 245, 417/390, 366, 76, 84, 53, 54; 166/313, 369, 105, 66.4, 106

(56) References Cited

U.S. PATENT DOCUMENTS

| | | | | |
|---|---|---|---|---|
| 3,765,483 | * | 10/1973 | Vencil | 166/265 |
| 4,183,722 | * | 1/1980 | Roeder | 417/172 |
| 4,294,573 | | 10/1981 | Erickson et al. | 417/83 |
| 4,790,376 | * | 12/1988 | Weeks | 166/68 |
| 5,033,545 | * | 7/1991 | Sudol | 166/312 |
| 5,372,190 | * | 12/1994 | Coleman | 166/68 |
| 5,555,934 | * | 9/1996 | Haufler | 166/68 |
| 5,562,161 | * | 10/1996 | Hisaw et al. | 166/372 |
| 5,881,814 | * | 3/1999 | Mills | 166/313 |
| 6,017,198 | * | 1/2000 | Traylor et al. | 417/390 |
| 6,045,333 | * | 4/2000 | Breit | 417/44.1 |

FOREIGN PATENT DOCUMENTS

| | | | |
|---|---|---|---|
| 2 261 030 | 5/1993 | (GB) | F04F 5/24 |
| 0 342 670 | 4/2000 | (GB) | E21B 43/12 |

* cited by examiner

*Primary Examiner*—Teresa Walberg
*Assistant Examiner*—Jeffrey Pwu
(74) *Attorney, Agent, or Firm*—Fletcher, Yoder & Van Someren

(57) ABSTRACT

A system and method that permits fluids, such as petroleum, to be pumped from two separate zones. A submergible pumping system, including a submergible electric motor driving a submergible pump, is deployed in a wellbore. The submergible pump intake is located in a first zone to intake a fluid. The fluid is discharged through a fluid-powered pump, such as a jet pump. The jet pump is coupled to a fluid intake disposed in a separate zone within the wellbore. The single system can be utilized to pump fluids from two different zones.

20 Claims, 2 Drawing Sheets

DUAL PUMP SYSTEM IN WHICH THE DISCHARGE OF A FIRST PUMP IS USED TO POWER A SECOND PUMP

FIELD OF THE INVENTION

The present invention relates generally to submergible pumping systems for raising fluids from wells and, particularly, to a dual pump system in which a first pump is powered by an electric motor, and a second pump is powered by the fluid discharge from the first pump.

BACKGROUND OF THE INVENTION

In producing petroleum and other useful fluids from production wells, it is generally known to provide a submergible pumping system for raising the fluids collected in a well. Production fluids enter a wellbore via perforations formed in a well casing adjacent a production formation. Fluids contained in the formation collect in the wellbore and may be raised by the submergible pumping system to a collection point above the earth's surface.

In an exemplary submergible pumping system, the system includes several components, such as a submergible electric motor that supplies energy to a submergible pump. The system may also include a variety of other components, such as motor protectors, pressure and temperature sensing instruments, gas separators and a variety of other components. A connector is used to connect the submergible pumping system to a deployment system. For example, a submergible pumping system may be deployed by production tubing through which production fluids, such as petroleum, are pumped to the surface of the earth. Other deployment systems include cable and coiled tubing.

Power is supplied to the submergible electric motor via a power cable that runs along the deployment system. For example, the power cable may be banded to the outside of the production tubing and directed to the submerged motor.

Generally conventional submergible pumping systems are used to pump fluids from a single location or zone within a wellbore. If fluid is to be pumped from another zone, an additional string of submergible pumping components must be deployed in that zone, either within the same wellbore or within another wellbore. This use of two separate submergible pumping systems, and possibly the requirement of two or more separate wellbores, is relatively complex and expensive.

It would be advantageous to have a dual pump, submergible pumping system, that could be utilized to draw fluids into separate intakes. The intakes could then be disposed in separate zones, e.g., above and beneath one another.

SUMMARY OF THE INVENTION

The present invention features a method for pumping fluids from a pair of zones located in a subterranean environment. The method includes deploying a submergible pumping system of the type including a submergible pump and a submergible electric motor. The submergible pumping system is deployed at a first zone. The method further includes pumping a first fluid located in the first zone with the pump. The method also includes discharging the first fluid from the pump through a second, fluid-powered pump. This second pump is utilized to pump a second fluid from a second zone.

According to another aspect of the invention, a system is provided for pumping fluids from a wellbore. The system includes a submergible pumping system having a submergible electric motor connected to a submergible pump. The submergible pump has a pump intake and a pump outlet through which a fluid is discharged. The system further includes a second pump having a pump intake that may be disposed in a fluid within a wellbore. This second pump is powered by the fluid discharged by the submergible pump through its pump outlet.

According to another aspect of the invention, a method is provided for pumping fluids from at least two different zones in a subterranean environment. The method includes locating a first pump intake at a first subterranean zone, and locating a second pump intake at a second subterranean zone. The method further includes powering a first pump with an electric motor to intake a fluid from the first subterranean zone, and discharging the fluid through a second pump to power the second pump. The second pump is utilized to intake an additional fluid from the second zone.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
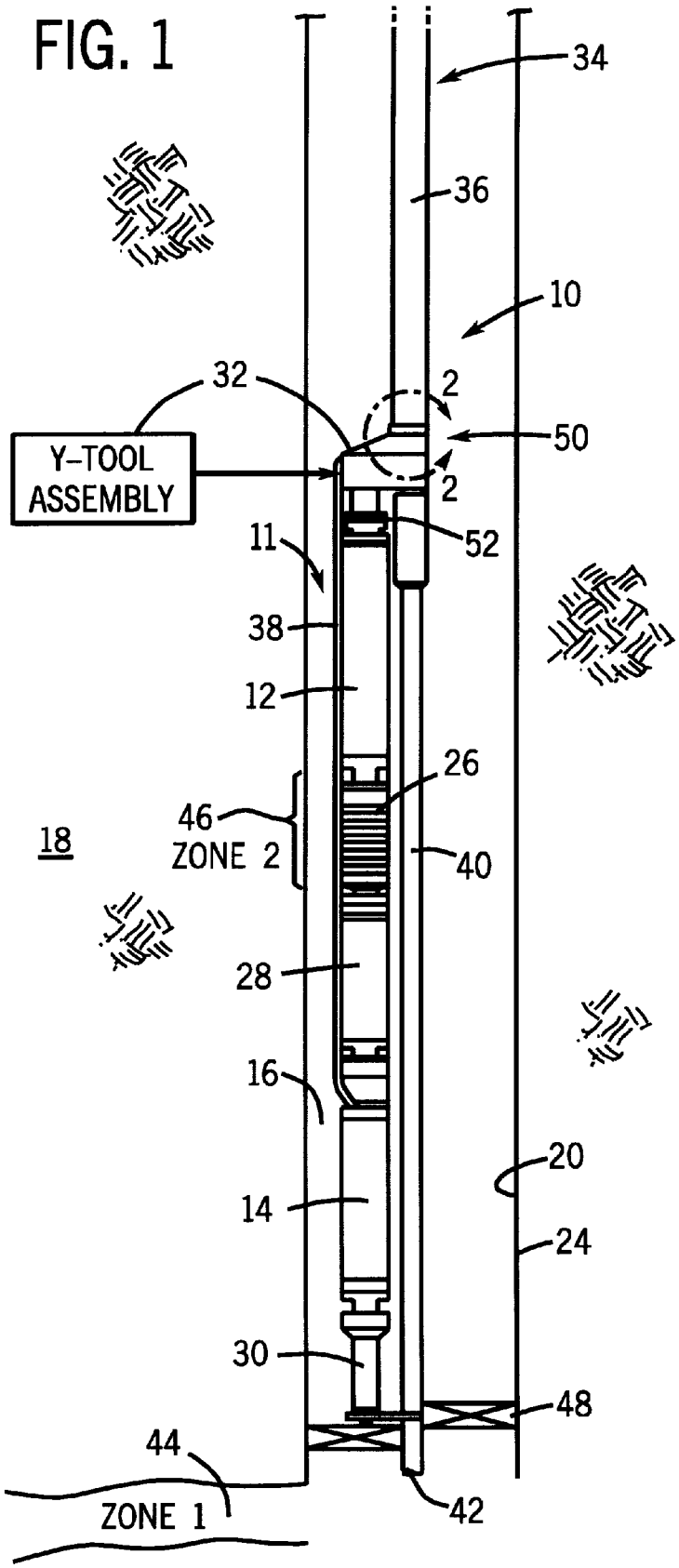
FIG. 1 is a front elevational view of a submergible pumping system positioned in a wellbore, according to a preferred embodiment of the present invention.

Referring generally to FIG. 1, a dual pumping system 10 is illustrated according to a preferred embodiment of the present invention. Dual pumping system 10 preferably includes an electric submergible pumping system 11.

Submergible pumping system 11 may comprise a variety of components depending on the particular application or environment in which it is used. However, system 11 typically includes at least a submergible pump 12 powered by a submergible electric motor 14. One example of a submergible pump 12 that may be utilized in a subterranean, wellbore environment is a centrifugal pump, such as is commonly used in the petroleum industry.

Dual pumping system 10 may be used in a variety of applications and environments for pumping a variety of fluids. A preferred utilization of pumping system 10 is deployment in a well 16 within a geological formation 18 containing desirable production fluids, such as petroleum. In this application, a wellbore 20 is drilled and lined with a wellbore casing 24.

As illustrated, electric submergible pumping system 11 is disposed in wellbore 20 and includes several components. For example, submergible pump 12 is connected to a pump intake 26 that may comprise a gas separator. Additionally a motor protector 28 may be connected intermediate submergible motor 14 and submergible pump 12. Motor protector 28 serves to isolate the well fluid from the internal motor oil within submergible motor 14. Additionally, a pressure and temperature sensing instrument 30 may be included in submergible pumping system 11.

In the illustrated embodiment, submergible pumping system 11 is connected to a fluid transfer housing, such as a Y-tool assembly 32. Y-tool assembly 32, in turn, is connected to a deployment system 34. Deployment system 34 potentially may comprise cable, coil tubing or production tubing. In the illustrated embodiment, deployment system 34 comprises production tubing 36 through which production fluids, e.g. petroleum, are pumped to the surface of the earth. Typically, a power cable 38 is deployed along production tubing 36 and submergible pumping system 11 to provide power to submergible motor 14. Power cable 38 may be banded to production tubing 36.

A section of bypass tubing 40 also is connected to Y-tool assembly 32. As illustrated, submergible pumping system 11 and bypass tubing 40 extend generally parallel to one another in wellbore 20. Bypass tubing 40 includes an intake 42 through which fluids may enter. Preferably, bypass tubing intake 42 is disposed in a first location or zone 44, and submergible pump intake 26 is disposed in a second location or zone 46. A packer assembly 48 may be combined with dual pump system 10 to separate first zone 44 from second zone 46.

Dual pump system 10 can be configured to pump fluids from a variety of different zones. However, in a typical application, first zone 44 is disposed beneath second zone 46 along wellbore 20. Additionally, the same, similar or different fluids can be pumped from each zone 44, 46, respectively.

To pump fluids from first zone 44 through intake 42 and bypass tubing 40, a second pump 50 is incorporated into dual pump system 10. Second pump 50 preferably is disposed at least partially in Y-tool assembly 32. Pump 50 is a fluid or hydraulic powered pump that is powered by the fluid discharged through a pump outlet 52 of submergible pump 12. In other words, submergible pump 12 draws fluid from second zone 46 through intake 26. This fluid then is pumped through submergible pump 12 and out pump outlet 52. The fluid is directed through Y-tool assembly 32 and pump 50. The energy of the fluid discharged from submergible pump 12 drives pump 50 which draws fluid through intake 42 and bypass tubing 40. In the design illustrated, the fluids drawn through intake 26 and bypass tubing intake 42 are combined and pumped to the surface of the earth through production tubing 36.

Figure 2:
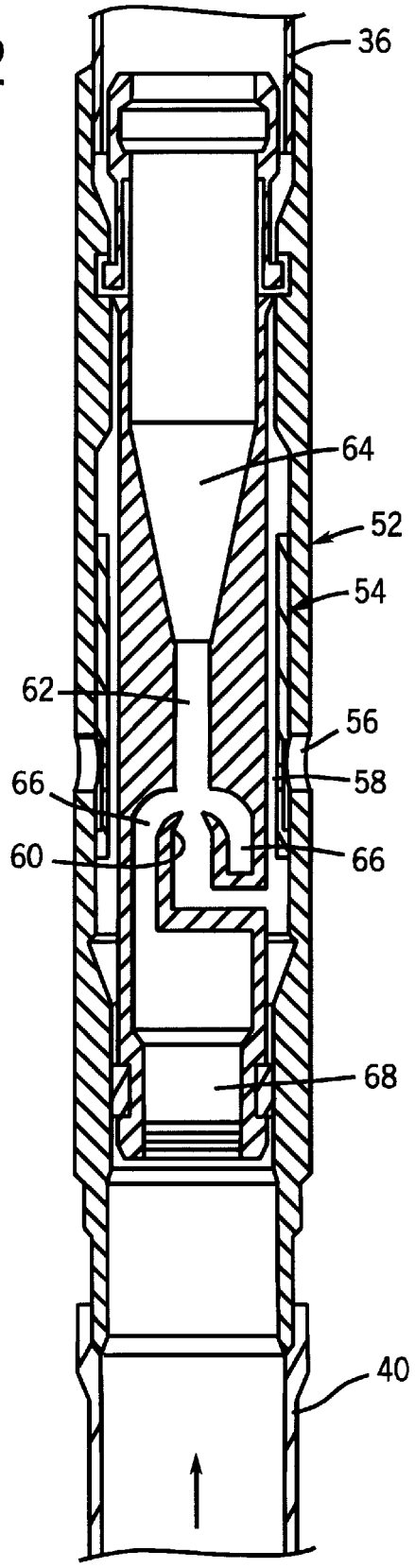
FIG. 2 is a cross-sectional view of a fluid-powered pump, taken generally along line 2—2 of FIG. 1.

A preferred fluid-driven pump 50 comprises a jet pump assembly 52, as illustrated in FIG. 2. Jet pump assembly 52 utilizes a jet pump 54 to create the required vacuum in bypass tubing 40 to draw fluid from first zone 44 into tubing intake 42 and through the jet pump assembly 52 into production tubing 36.

In operation, submergible pump 12 discharges fluid through pump outlet 52 and Y-tool assembly 32 to jet pump 54. The fluid is forced through jet pump assembly openings 56 into an interior annular chamber 58. From interior annular chamber 58, the fluid is directed through a jet pump nozzle 60 and into a narrowed venturi passage 62. As the fluid leaves venturi passage 62, it moves into an expansion chamber 64 that directs the fluid into production tubing 36.

As the production fluid from second zone 46 is forced through jet pump nozzle 60 and narrowed venturi passage 62, a lower pressure is created in a low pressure chamber 66 surrounding jet pump nozzle 60. Low pressure chamber 66 is in fluid communication with a jet pump assembly inlet 68 which, in turn, is in fluid communication with bypass tubing 40. The reduced pressure in low pressure chamber 66 is sufficient to draw a second fluid from first zone 44 into intake 42 and up through bypass tubing 40 into low pressure chamber 66 of jet pump assembly 52. At this point, the second fluid is effectively pulled through narrowed venturi passage 62 with the fluid discharged from submergible pump 12 through jet pump nozzle 60. The combined fluids flow through jet pump assembly 52 and are pumped to the earth's surface via production tubing 36. It should be noted that the particular fluids pumped from first zone 44 and second zone 46 may be the same or different types of fluid.

The use of fluid-powered pump 50 allows production fluids to be lifted from two zones in a single wellbore without the requirement of running two electric submergible pumping systems and two production tubing strings into the wellbore. The illustrated embodiment is a preferred embodiment, but it can be adapted to perform a variety of functions in a variety of environments. For example, the fluid-powered pump 50 could be used to move fluids into another zone, around a packer assembly, etc.

It will be understood that the foregoing description is of a preferred embodiment of this invention, and that the invention is not limited to the specific form shown. For example, numerous submergible pumping system configurations can be employed; a variety of jet pump designs may be utilized; and the dual pump system can be adapted to pump fluids from vertically or transversely separated zones. These and other modifications may be made in the design and arrangement of the elements without departing from the scope of the invention as expressed in the appended claims.

What is claimed is:

1. A method for pumping fluids from a pair of zones located in a subterranean environment, comprising:

deploying a submergible pumping system, including a pump and an electric motor, at a first zone;

pumping a first fluid, located in the first zone, with the pump;

discharging the first fluid through a fluid powered pump; and pumping a second fluid from a second zone by the fluid powered pump.

2. The method as recited in claim 1, wherein deploying includes deploying the submergible pumping system in a wellbore.

3. The method as recited in claim 2, further comprising deploying the fluid powered pump in the wellbore.

4. The method as recited in claim 1, wherein pumping a first fluid includes pumping a fluid comprising petroleum.

5. The method as recited in claim 1, wherein discharging includes discharging the first fluid through a jet pump.

6. The method as recited in claim 1, wherein pumping comprises pumping the second fluid from the second zone located at a greater distance beneath the earth's surface than the first zone.

7. The method as recited in claim 4, wherein pumping a second fluid includes pumping a fluid comprising petroleum.

8. A system for pumping fluids from a wellbore, comprising:

a submergible pumping system including a submergible electric motor connected to a submergible pump having a submergible pump intake and a submergible pump outlet through which a pumped fluid is discharged; and a second pump having pump intake that may be disposed in a fluid within a wellbore, wherein the second pump is powered by the pumped fluid that is discharged from the submergible pump outlet.

9. The system as recited in claim 8, wherein the second pump includes a venturi.

10. The system as recited in claim 8, wherein the second pump comprises a jet pump.

11. The system as recited in claim 8, wherein the submergible pump intake and the pump intake are separated a desired distance to accommodate pumping of fluids from separate subterranean zones.

12. The system as recited in claim 8, wherein the submergible pump is connected to the second pump by a Y-tool assembly.

13. The system as recited in claim 8, further comprising a production tubing disposed in fluid communication with the submergible pumping system and the second pump.

14. A method for pumping fluids from at least two different zones in a subterranean environment, comprising:

locating a first pump at a first subterranean zone;

locating a second pump at a second subterranean zone; and discharging the fluid through the second pump to power the second pump for intaking an additional fluid from the second zone.

15. The method as recited in claim 14, wherein locating a first pump includes locating the first pump in a wellbore.

16. The method as recited in claim 15, wherein locating a second pump includes locating the second pump in the wellbore.

17. The method as recited in claim 16, further comprising pumping the fluid and the additional fluid to a surface of the earth.

18. The method as recited in claim 17, wherein pumping the fluid and the additional fluid includes pumping petroleum.

19. The method as recited in claim 17, further comprising assembling the first pump and the electric motor in an electric submergible pumping system.

20. The method as recited in claim 14, wherein discharging includes discharging the fluid through a jet pump.

* * * * *